US007681273B2

(12) United States Patent
Jung

(10) Patent No.: US 7,681,273 B2
(45) Date of Patent: Mar. 23, 2010

(54) WATER POWERED COUNTER ROTOR CLEANER

(76) Inventor: Man-Young Jung, 2750 E Washington Blvd. Ste 150, Pasadena, CA (US) 91107-6201

( * ) Notice: Subject to any disclaimer, the term of this patent is extended or adjusted under 35 U.S.C. 154(b) by 555 days.

(21) Appl. No.: 11/801,012

(22) Filed: May 8, 2007

(65) Prior Publication Data

US 2008/0276391 A1 Nov. 13, 2008

(51) Int. Cl.
*A47L 21/02* (2006.01)

(52) U.S. Cl. ..... 15/29; 15/21.1; 15/22.1; 15/28

(58) Field of Classification Search ..... 15/21.1, 15/22.1, 28, 29
See application file for complete search history.

(56) References Cited

U.S. PATENT DOCUMENTS 3,760,447 A * 9/1973 Vivion ..... 15/29
4,586,210 A * 5/1986 Mueller ..... 15/29
2008/0229529 A1 * 9/2008 Viner ..... 15/29

* cited by examiner

*Primary Examiner*—Joseph J Hail, III
*Assistant Examiner*—Shantese McDonald
(74) *Attorney, Agent, or Firm*—Clement Cheng

(57) ABSTRACT

A cleaning attachment to water hose is provided comprising an outer shell having a dome-shaped base skirt including a connector member for tightening the flared top end of the neck section of the outer shell to the water hose in a sealing engagement, a main ball valve to permit passage of water and out of alignment therefrom to block the entire water stream; and a water chute with two extensions each extending approximately in parallel with the interior walls of the outer shell and in a first spiral form. A dome-shaped outer rotor with a number of fans and a bottom brush is rotationally positioned in the base skirt under the water chute for receiving the pressurized impacts of the water streams to activate the outer rotor in a first direction.

16 Claims, 6 Drawing Sheets

WATER POWERED COUNTER ROTOR CLEANER

BACKGROUND OF THE INVENTION

A. Field of the Invention

The present invention relates to cleaning tools, and more particularly to a water-powered rotary cleaning attachment for use with hose fittings.

B. Description of the Prior Art

Washing driveways and architectural walls with water hose becomes easier using a nozzle attachment with a control handle.

Still, mossy areas are tough to clean without separate scrubbing instruments that increase the labor time consumption as well as the amount of water in the draught areas spreading worldwide.

In addition, cleaning a vehicle requires not only a planar scrubbing movement but also complex series of activities like soaking, soaping, scrubbing, then washing and finally rinsing all over the surfaces of the vehicle. However, it is only after the surfaces are dried up to find untouched areas that need another cycle of watering instead of conservation thereof.

The thought of supplying the pressurized household water to a rotational brush head and providing an active wash brushes have been known through many US Patents including U.S. Pat. No. 4,417,826 to Floros and U.S. Pat. No. 5,619,766 to Zhadanov et al. both disclosing body wash rotary brushes and U.S. Pat. No. 6,915,541 to Alexander and materialized by actual products in the market with limited.

However, numerous trials of actual water nozzles of this kind have not survived the test of the market and time when the household pressurized water may be much more effectively used than known in the art to conserve water and extra energy of electricity.

The present invention is to provide a rotational cleaner for controlling a stream of cleaning water in more effective way than known before.

Water from the hose first branches in two ways in the cleaner: one flows to an outer water chute under a shell of the cleaner ejecting water to an outer rotor with multiple fans thru a first set of inward nozzle holes. The nozzle holes shoot water to the outer rotor fans obliquely in one direction. A second internal nozzle has its nozzle holes for projecting water to an inner rotor with fans in the same slanted angle but in the opposite direction so that the inner fan rotor spins in one direction like counterclockwise while the outer rotor turns clockwise.

By counter-rotating the coaxial fan-rotors, the rotor cleaner eliminates the torque effect, creates much less noise and improves the cleaning power for about 15-20% more, compared to various single brush rotor types.

Dual rotors provide multiple benefits, especially in the household pressurized water outlets. They provide increased stain lift per a unit water pressure and improved stability over traditional single rotor brush heads. A coaxial or concentric shaft arrangement is driven by a single water source thus providing improved balance and cleaning stability. Counter rotation eliminates gyroscopic effects as well as the need for added efforts to hold the brush head while at the same time putting more waterpower to the rotor brushes. And the counter-rotor cleaner has dual control knobs for each of the nozzle sets to control the water flow strength as well as fine tune the balanced opposite rotations.

SUMMARY OF THE INVENTION

A counter rotor cleaner according to a first embodiment of the present invention comprises an outer shell shaped like a semi-spherical cap having an integral upright housing for movably supporting a rotor/brush assembly located under the shell and an upper neck for holding a connector for connection with an end of a water hose.

The neck has tubular inner walls of changing diameters of which a larger upper section houses a main valve incorporating a ball with a central large hole and an on-off knob fastened to the ball from outside of the neck via a tight through hole. The ball is also seated on a rounded annular step formed by a smaller diameter of a lower neck section whereby the knob is turned to a vertical position the ball to allow water to pass down to the housing. To break or reduce the flow of water, the knob may be turned to either direction horizontally.

Aligned with the main valve with a distance in the housing is a control valve that extends into the interior of the outer shell. This valve is positioned in relation to the main valve so that it passes a part the water flow out of the main valve along a central path while allowing the rest of the stream to be distributed through an annular conduit formed by the interior walls of the housing and an axial stem for housing the control valve at its top end just as the neck holding the main valve. The control valve may have a bored ball and a control knob, which is positioned on the exterior of the housing and connected by a threaded rod extending through holes in the housing as well as the stem in order to permit an outside control of the water flow. The housing may be partially withdrawn toward its center to keep the control knob at a lower profile.

When both the main and control valves are completely turned on, water is evenly distributed in two concentrically annular paths. By turning only the control valve, the central water flow may be increased or decreased.

The stem also has an elongated neck portion extending downward midway in the space within the shell and is provided with an integral upper nozzle section and a lower nozzle section affixed to the upper section to form an internal nozzle. The lower nozzle section may have an integral sleeve press fitted into the axial stem for the internal nozzle to support oppositely moving components externally at the axial stem and internally at the sleeve respectively while supplying the water force according to the present invention.

A main nozzle of the cleaning device is formed by a spiral water chute that has a center hub for mounting the chute concentrically onto the inner wall of the housing. For the purpose of attachment of the hub and to keep water advance through the annular conduit into the chute, the hub has at least four outwardly extending ribs pushed evenly diametrically against the inner wall of the housing to maintain a secure hold between the two components. In addition, the shell may be provided with an internal spiral recess for holding the chute in a tight seal. The opposite tips of the chute are formed with directional nozzle holes. Rotationally positioned right below the chute is a dome-shaped outer rotor with multiple radial fans extending integral from the sidewalls of the rotor. When assembled, the mid level of the fans becomes approximately in level with the nozzle hole and thus gets the strongest hits of the water jet. The bottom of the rotor may be flat and is provided with cleaning edges of different treatments depending on the application of the cleaning device.

The outer rotor is sleeved at its top bearing sleeve over the axial stem of the internal nozzle before the nozzle is forcibly threaded into secured hub of the water chute during assembly so that it is freely rotational with a ball bearing sandwiched therebetween.

An inner rotor has the similar structure to the outer rotor with a reduced scale to be housed within the internal span of the nozzle without interference. The inner rotor has multiple fans and a smaller pattern of brush at the bottom and a shaft at the top, which is inserted into the sleeve of the nozzle with a ball bearing installed therebetween. The shaft of the rotor may be then secured at its top end by disc member screwed from the top of the sleeve into the shaft. The internal nozzle is in a spiral form directed opposite to the upper outer spiral form of chute and has a couple of diametrically opposite nozzle holes for producing the counterclockwise water jets toward the inner rotor, which has a number of radial fans 84 facing the nozzle holes at their mid level.

According to a second embodiment of the present invention a counter rotor cleaner for attachment to a water hose is provided with a side-by-side valve structure. The cleaner comprises an outer shell having a dome-shaped base skirt, a generally tubular housing protruding from the top center of the base skirt and terminating with a shoulder and a neck section protruding upwardly from the shoulder of the housing and having an inlet opening for receiving water from the hose and a couple of outlet openings connected to the housing.

There is a twin valve including two laterally positioned larger inner diameters at the side of the inlet opening of the neck section, two smaller inner diameters connected to the larger inner diameters, a pair of balls each seated on an annular step formed at the transition between the two differentiated inner diameters of the neck section and a pair of knobs located externally of the neck section and connected centrally to the balls at their points of contact with the larger inner diameters of the neck section to rotate the balls respectively within the neck section. Each of the balls has a large central hole that is selectively in alignment with the longitudinal axis of the neck portion to permit passage of water at least partially and out of alignment therefrom to block the part of water stream. The cleaner also includes an outer water chute with two extensions each extending approximately in parallel with the interior walls of the outer shell, the chute communicating with one of the outlet openings of the neck section for receiving at least a part of water through one of the valves, and the chute extensions having at their respective tips a nozzle hole for directing a pressurized stream of water obliquely toward the center of the base skirt of the shell. Under the water chute in the base skirt a dome-shaped outer rotor is rotationally positioned having a top bearing sleeve and a number of fans extending along the exterior surfaces of the rotor body for receiving the pressurized impacts of the water streams to activate the outer rotor in a first direction. The outer rotor has a flat bottom which may be provided with a replaceable cleaning brush. There is an inner water chute within the space of the outer rotor having two extensions each extending approximately in parallel with the interior walls of the outer shell, the chute communicating with the other of the outlet openings of the neck section for receiving at least a part of water through the other valve. And the inner chute extensions have at their respective tips a nozzle hole for directing a pressurized stream of water obliquely toward the center of the base skirt of the shell in a direction opposite to the direction of the water stream from the outer water chute. Under the inner water chute is a dome-shaped inner rotor having a shaft rotationally inserted through a bearing sleeve in the inner water chute and a number of fans extending along the exterior surfaces of the rotor body for receiving the pressurized impacts of the water streams from the nozzle holes of the inner water chute to activate the inner rotor in a second direction opposite to the first direction of rotation of the outer rotor. The inner rotor has a flat bottom, which is provided with a cleaning brush at least temporarily.

The cleaning attachment may also comprise a handle attachment connected between the cleaning attachment and the water hose in a sealing engagement to allow a fluid communication and a convenient handling of the attachment against a cleaning surface.

The connector may be made as a separate member attached to a flared top end of the neck section of the outer shell for tightening it to the water hose in a sealing engagement.

The cleaning attachment has the bottoms of the rotors replaceable and selected from a group of cleaning edges including brushes of different firmness and other abrasive surfaces.

The outer water chute extends in diametrically opposite spiral directions while the inner water chute extends in the similar spiral shape but in reverse to the outer water chute direction of extensions.

Embodiments of the invention will now be described by way of example with reference to the accompanying drawings.

BRIEF DESCRIPTION OF THE DRAWINGS

Similar reference numbers denote corresponding features throughout the attached drawings.

DETAILED DESCRIPTION OF THE PREFERRED EMBODIMENT

Figure 1:
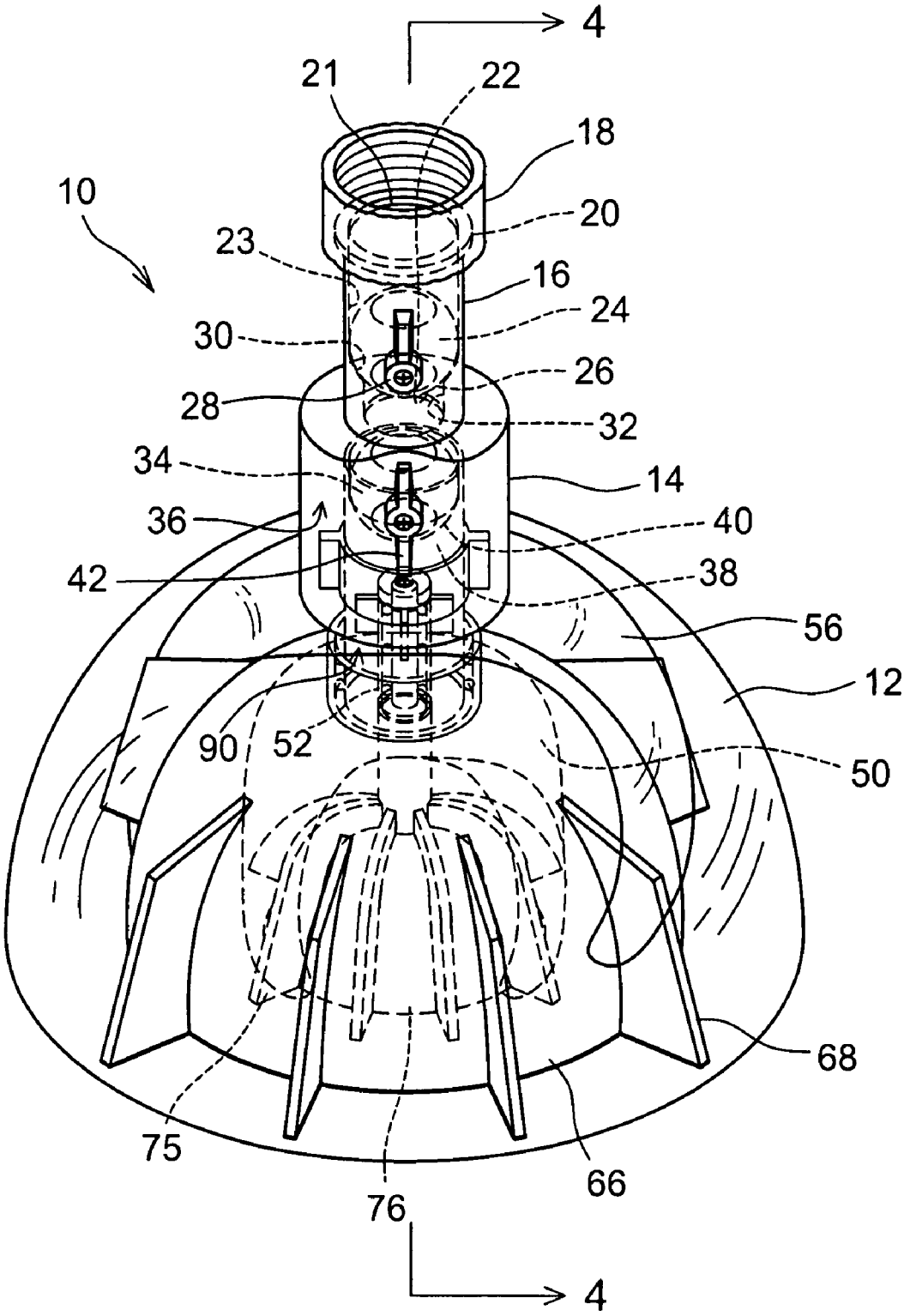
FIG. 1 is a perspective view of a counter rotor cleaner according to a first embodiment of the present invention.
Figure 4:
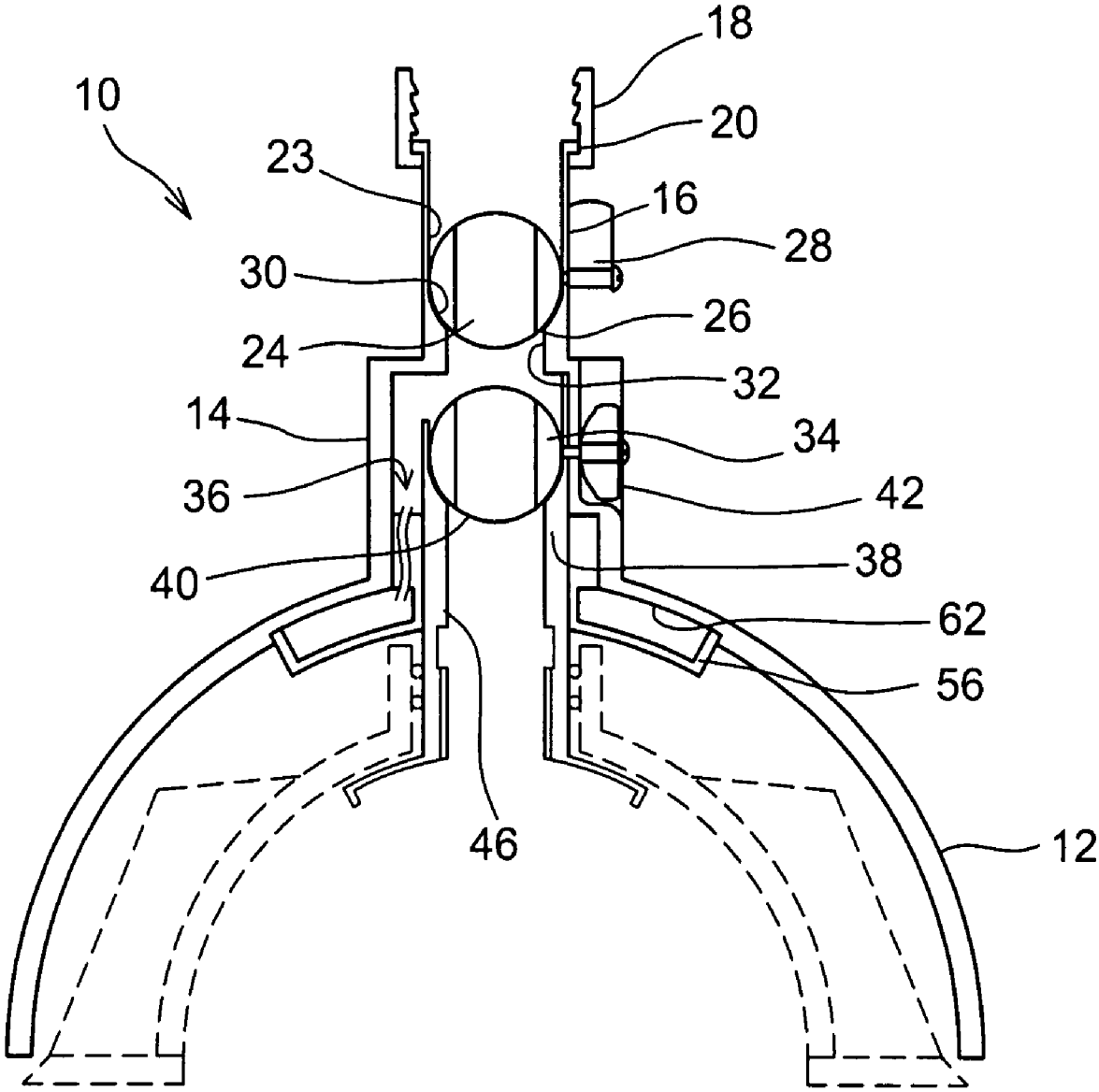
FIG. 4 is a cross sectional view of the cleaner taken along line 4-4 of FIG. 1 to show the area of the connection head wherein the water channel is controlled by the control knobs arranged in series.
Figure 5:
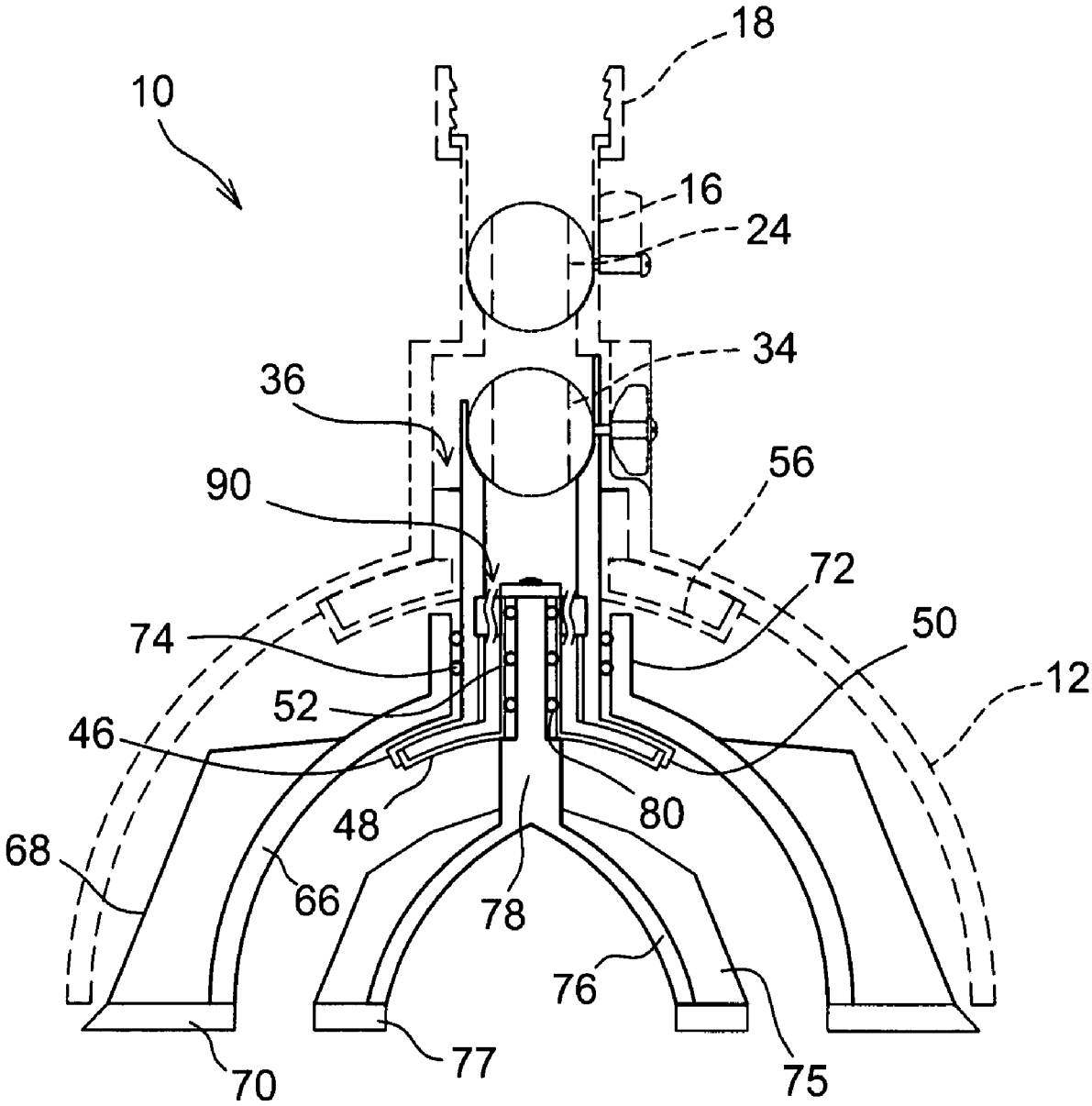
FIG. 5 is a cross sectional view similar to FIG. 4 to show the rotors mounted concentrically to receive directional water jets to operate the waterpower brushes on the rotors.

With reference to FIGS. 1, 4 and 5 together, a counter rotor cleaner according to an embodiment of the present invention is generally denoted as a device 10 having an outer shell 12 of a hard plastic material. The shell 12 may take the form of a semi-spherical cap having an integral upright housing 14 for movably supporting a rotor/brush assembly located under the shell 12. The housing 14 also has a shoulder 15 from which an upper neck 16 is extending to hold a connector 18 for connection with an end of a water hose directly or via a handle attachment that stiffens a length of the hose connected in turn to a faucet. In order to give a clearer view of the major components inside, the shell 12 is depicted as having transparent walls but opaque or semi-transparent materials may be used instead.

Figure 2:
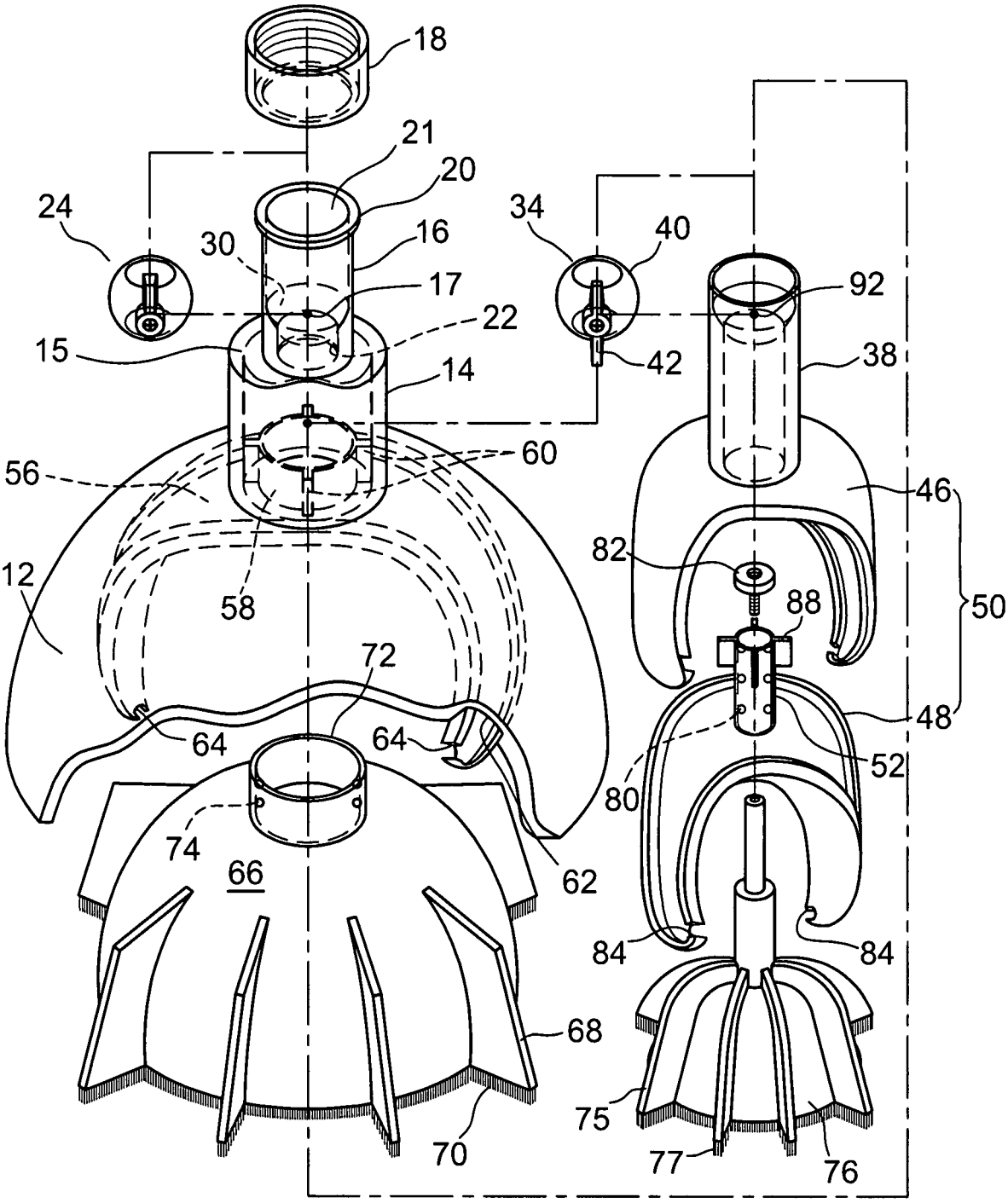
FIG. 2 is an exploded perspective view generally showing the assembly of the cleaner of FIG. 1.

The connector 18 may be a nut rotatably held by a flared top end 20 of the neck 16 as shown clearly in an exploded view of the cleaner 10 in FIG. 2. The neck section 16 has an inlet opening 21 where the connector 18 is joined for supplying water from the hose to the outer shell 12 and an outlet opening 22 connected to the housing 14. The neck section 16 has tubular inner walls of changing diameters of which a larger upper section 23 houses a main valve 24 incorporating a ball 26 with a central large hole and an on-off knob 28 fastened to the ball 26 from outside of the neck 16 via a tight through hole 17. The ball 26 is also seated on a rounded annular step 30 formed by a smaller diameter of a lower neck section 32. Therefore, when the knob 28 is turned to a vertical position the ball 26 allows water to pass down to the housing 14. To break or reduce the flow of water, the knob 28 may be turned to either direction horizontally. The ball 26 may be made of plastic. A plastic replacement sleeve not shown may be fitted into the upper neck section 23 to prevent the valve 24 from leaking after a lengthy use of the device 10. Alternatively, brass is a material of choice for the ball 26 and sleeve to improve the durability of the device 10. Also, appropriate elastic washers may be put in place at moving parts in the valves of the cleaner device 10 as is well known in the art of plumbing.

Aligned with the main valve 24 with a distance in the housing 14 is a control valve 34 that extends into the interior of the outer shell 12. This valve 34 is positioned in relation to the main valve 24 so that it passes a part the water flow out of the main valve 24 along a central path while allowing the rest of the stream to be distributed through an annular conduit 36 formed by the interior walls of the housing 14 and an axial stem 38 housing the control valve 34 at its top end just as the neck 16 holding the main valve 24. The control valve 34 may have a bored ball 40 and a control knob 42, which is positioned on the exterior of the housing 14 and connected by a threaded rod extending through holes in the housing 14 as well as the stem 38 in order to permit an outside control of the water flow. The housing 14 may be partially withdrawn toward its center to keep the control knob 42 at a lower profile.

Therefore, when both of the valves 24 and 34 are completely turned on, water is evenly distributed in two concentrically annular paths. By turning only the control valve 34, the central water flow may be increased or decreased.

The stem 38 also has an elongated neck portion extending downward midway in the space within the shell 12 and is provided with an integral upper nozzle section 46 and a lower nozzle section 48 affixed to the upper section 46 to form an internal nozzle 50. The lower nozzle section 48 may have an integral bearing sleeve 52 press fitted into the axial stem 38 for the internal nozzle 50 to support oppositely moving components externally at the axial stem 38 and internally at the sleeve 52 respectively while supplying the water force according to the present invention.

A main nozzle 54 of the cleaning device 10 is formed by a spiral water chute 56 that has a center hub 58 for mounting the chute 56 concentrically onto the inner wall of the housing 14. For the purpose of attachment of the hub 58 and to keep water advance through the annular conduit 36 into the chute 56, the hub 58 has at least four outwardly extending ribs 60 pushed evenly diametrically against the inner wall of the housing 14 to maintain a secure hold between the two components. In addition, the shell 12 may be provided with an internal spiral recess 62 for holding the chute 56 in a tight seal. The opposite tips of the chute 56 are formed with directional nozzle holes 64, which are in this embodiment extending toward the right turn resulting in a clockwise water jets aimed inwardly of the shell 12 at a mid level when viewed from above the depicted device. Rotationally positioned right below the chute 56 is a dome-shaped outer rotor 66 with multiple radial fans 68 extending integral from the sidewalls of the rotor 66. When assembled, the mid level of the fans 68 becomes approximately in level with the nozzle hole 64 and thus gets the strongest hits of the water jet. The bottom of the rotor 66 may be flat and is provided with cleaning edges 70 of different treatments depending on the application of the cleaning device 10. For this purpose, the bottom of the rotor brushes 70 may be made in the form of a replaceable component complete with one of a group of cleaning edges including brushes and other abrasive surfaces.

The outer rotor 66 is positioned at its top bearing sleeve 72 over the axial stem 38 of the internal nozzle 50 before the nozzle 50 is forcibly threaded into secured hub 58 of the water chute 56 during assembly so that it is freely rotational with a ball bearing 74 sandwiched therebetween shown schematically in the drawing.

There is an inner rotor 76 that has the similar structure to the outer rotor 74 with a reduced scale to be housed within the internal span of the nozzle 50 without interference. The inner rotor 76 has multiple fans 75 and a smaller pattern of brush 77 at the bottom and a shaft 78 at the top which is inserted into the sleeve 52 of the nozzle 50 with a ball bearing 80 installed therebetween. The shaft 78 of the rotor 76 may be then secured at its top end by disc member 82 screwed from the top of the sleeve 52 into the shaft 78. The internal nozzle 50 is in a spiral form directed opposite to the upper outer spiral form of chute 56 and has a couple of diametrically opposite nozzle holes 84 for producing the counterclockwise water jets toward the inner rotor 76, which has a number of radial fans 84 facing the nozzle holes 86 at their mid level.

The assembly of the entire cleaning device 10 may be accomplished in the reverse sequence to the order of descriptions above. The upper and lower sections 46, 48 of the internal nozzle 50 may be first fit together with the aid of the sleeve 52 having multiple pairs of outwardly extending ribs 88 pushed against the interior walls of the axial stem 38 on the upper nozzle section 46 to maintain am inner annular conduit 90 for guiding water from the control valve 34 into the internal nozzle 50. Then, the rotor 76 is inserted with a deposit of bearing 80 into the sleeve 52 and secured therein by the disc 82.

Next, the valve ball 40 may be dropped in the top section of the axial stem 38 with the control knob 42 set aside. The ball 40 may be temporarily held so that its fastener hole is in alignment with a through hole 92 of the stem 38 using a molten wax to facilitate the assembly of the knob 42 at a later stage. The wax will help in maintaining operational smoothness and water tightness during use of the product.

The internal nozzle/rotor subassembly may now support the outer rotor 66 with the axial stem 38 threading the top bearing sleeve 74 inserted into an annular space formed between them so that the two rotors 66, 76 freely rotate about the stem 38 and sleeve 52 of the assembled nozzle 50, respectively. The water chute 56 may be conveniently threaded over the axial stem 38 of the internal nozzle 50 above the outer rotor 66 and then secured thereto by a chemical or thermal as well as a mechanical method of fastening. Alternatively, the hub 58 of the water chute 56 may be internally threaded to conveniently engage an external thread on the top end of the axial stem 38 wherein the chute 56 may be separately assembled with the outer shell 12 only to receive the internal nozzle/rotor subassembly to speed up the manufacturing process.

Finally, the two valves 24, 34 may be completed with the addition of the external knobs and the hose connector 18 may be slid over the top end 20 of the neck 16 followed by a flaring treatment to keep the connector 18 in place. Alternatively, the connector 18 may be formed integral to the neck section 16 without interfering the performance of the cleaning device 10.

Figure 3:
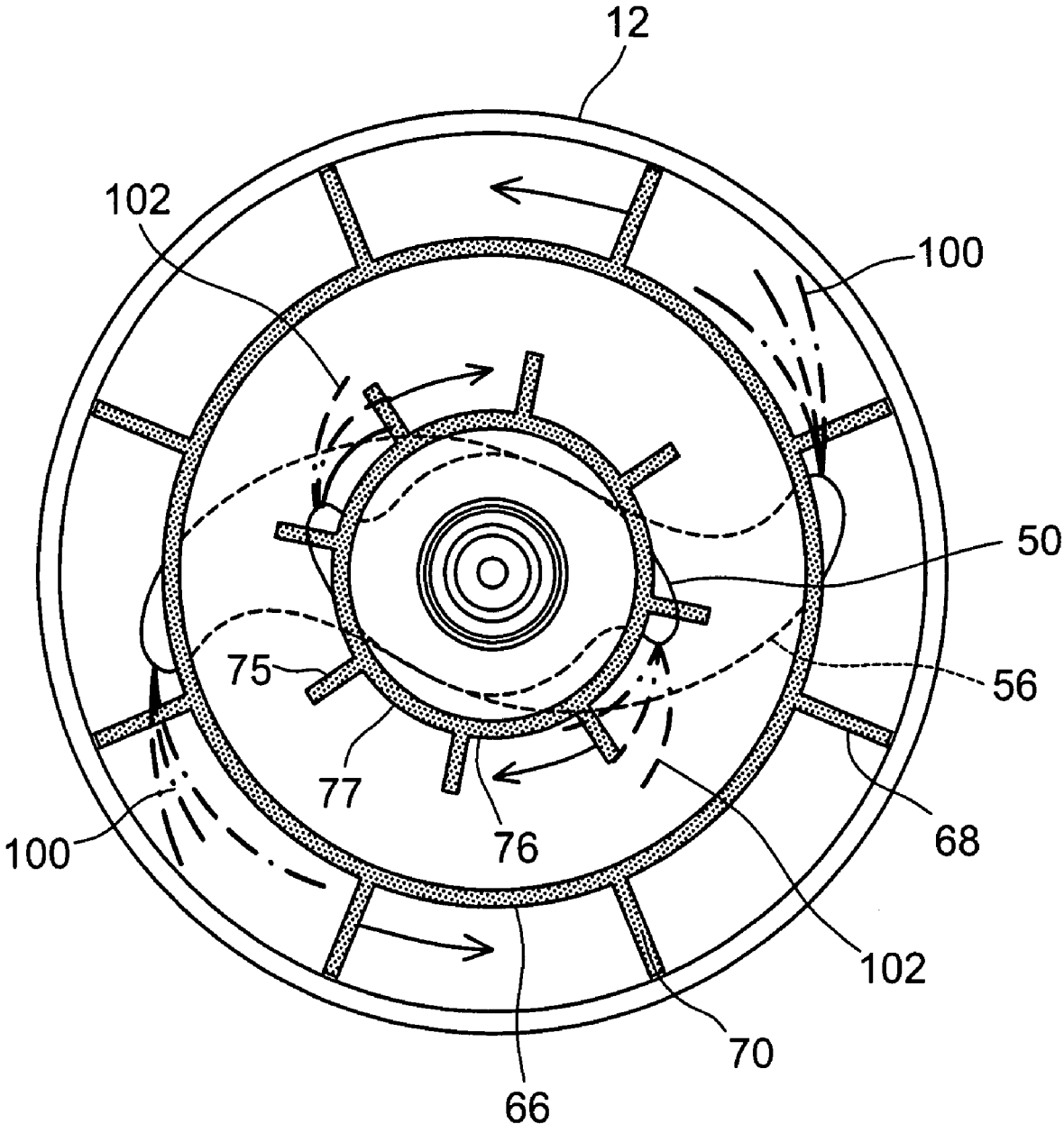
FIG. 3 is a bottom view of the counter rotor cleaner of FIG. 1 showing the opposite directions of rotation of the water propelled rotors inside the cleaner.

FIG. 3 shows in a bottom view the counter rotating operation of the concentric brushes 70, 77 filling in the bottom profiles of the two rotors 66, 76, respectively. When both of the valves 24, 34 are opened to accept the pressurized household water into the housing 14 of the shell 12, the water stream is divided into two branches at the control valve 34 to further swirl each of the streams along the spiral channels of the water chute 56 and internal nozzle 50. The water chute 56 ejects a first pair of highly pressurized water jets 100 to propel the rotor 66 in one direction while the inner rotor 76 propels the brush 77 in the other direction due to the oppositely swirled water stream 102 ejected aiming the same sides of the fans 75 at two diametrically opposite locations at close proximity of the rotor 76.

Figure 6:
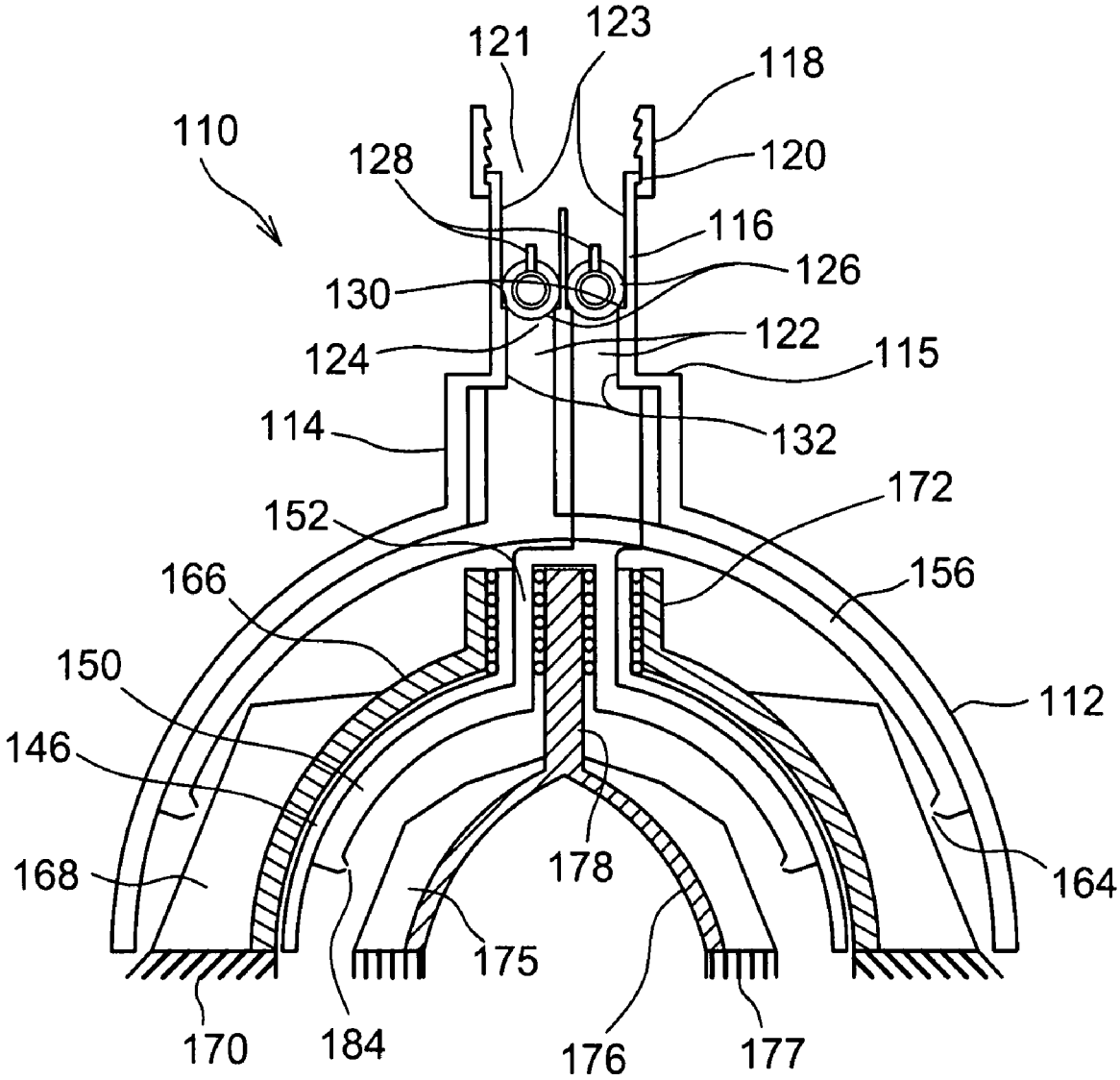
FIG. 6 is a cross sectional view of a counter rotor cleaner according a second embodiment of the present invention.

According to a second embodiment of the present invention, a counter rotor cleaner 110 adapted for attachment with a water hose (not shown) is provided with a side-by-side valve control as shown in FIG. 6.

The cleaner 110 comprises an outer shell 112 having a dome-shaped base skirt, a generally tubular housing 114 protruding from the top center of the base skirt and terminating with a shoulder 115 and a neck section 116 protruding upwardly from the shoulder 115 of the housing 114 and having an inlet opening 121 with a connector 118 for receiving water from the hose and a couple of outlet openings 122 connected to the housing 114.

There is a twin valve 124 including two laterally positioned larger inner diameters 123 at the side of the inlet opening 121 of the neck section 116, two smaller inner diameters 132 connected to the larger inner diameters 123, a pair of balls 126 each seated on an annular step 130 formed at the transition between the two differentiated inner diameters of the neck section 116 and a pair of knobs 128 located externally of the neck section 116 and connected centrally to the balls 126 at their points of contact with the larger inner diameters 123 of the neck section 116 to rotate the balls 126 respectively within the neck section 116. Each of the balls 126 has a large central hole that is selectively in alignment with the longitudinal axis of the neck portion 116 to permit passage of water at least partially and out of alignment therefrom to block the part of water stream.

The cleaner 110 also includes an outer water chute 156 with two extensions each extending generally in parallel with the interior walls of the outer shell 112. The chute 156 communicates with one of the outlet openings 122 of the neck section 116 for receiving at least a part of water through one of the valves 124 and the chute extensions have at their respective tips a nozzle hole 164 for directing a pressurized stream of water obliquely toward the center of the base skirt of the shell 112. Under the water chute 156 in the base skirt a dome-shaped outer rotor 166 is rotationally positioned having a top bearing sleeve 172 and a number of fans 168 extending along the exterior surfaces of the rotor body for receiving the pressurized impacts of the water streams to activate the outer rotor 166 in a first direction. The outer rotor 166 has a flat bottom, which may be provided with a replaceable cleaning brush 170.

There is an inner water chute 150 within the space of the outer rotor 166 having two extensions attached to a dome-shaped inner shell 146 extending generally in parallel with the interior walls of the outer shell 112, the inner chute 150 communicating with the other of the outlet openings 122 of the neck section 116 for receiving at least a part of water through the other valve. And the inner chute extensions have at their respective tips nozzle holes 184 for directing pressurized streams of water obliquely toward the center of the base skirt of the shell 112 in a direction opposite to the direction of the water stream from the outer water chute 156. Under the inner water chute 150 is a dome-shaped inner rotor 176 having a shaft 178 rotationally inserted through a bearing sleeve 152 in the inner water chute 150 and a number of fans 175 extending along the exterior surfaces of the rotor 176 for receiving the pressurized impacts of the water streams from the nozzle holes of the inner water chute 150 to activate the inner rotor 176 in a second direction opposite to the first direction of rotation of the outer rotor 166. The inner rotor 176 has a flat bottom, which is provided with a cleaning brush 177 at least temporarily.

The cleaner 110 may also comprise a handle attachment (not shown) connected between the cleaner and the water hose in a sealing engagement to allow a fluid communication and a convenient handling of the cleaner against a cleaning surface.

The connector 118 may be made as a separate member attached to a flared top end 120 of the neck section 116 of the outer shell 112 for tightening it to the water hose in a sealing engagement.

The bottom brushes 170, 177 of the rotors 166 and 176 may be replaceable and selected from a group of cleaning edges including brushes of different firmness and other abrasive surfaces.

The outer water chute 156 extends in diametrically opposite spiral directions while the inner water chute 150 extends in the similar spiral shape but in reverse to the direction the outer water chute 156 extends.

According to the present invention, an optimal counter rotation in the unique nozzle structure provides a calm handling of the cleaner with improved control of water volume and pressure at various cleaning surfaces without a compromise in waterpower requiring none of the extra energy and commitment to wasteful process of pressurizing water.

Therefore, while the presently preferred form of the nozzle cleaner has been shown and described, and several modifications thereof discussed, persons skilled in this art will readily appreciate that various additional changes and modifications may be made without departing from the spirit of the invention, as defined and differentiated by the following claims.

The invention claimed is:

1. A cleaning attachment to water hose comprising:

an outer shell having a dome-shaped base skirt, a generally tubular housing protruding from the top center of the base skirt and terminating with a shoulder and a neck section protruding upwardly from the shoulder of the housing and having an inlet opening with a connector for tightening the neck section of the outer shell to the water hose in a sealing engagement and an outlet opening connected to the housing;

a main valve including a larger inner diameter at the side of the inlet opening of the neck section, a smaller inner diameter at the side of the outlet opening of the neck section, a ball seated on an annular step formed at the transition between the two different inner diameters of the neck section and a knob located externally of the neck section and connected centrally to the ball at its point of contact with the larger inner diameter of the neck section to rotate the ball within the neck section, the ball having a large central hole that is selectively in alignment with the longitudinal axis of the neck portion to permit passage of water and out of alignment therefrom to block the entire water stream;

a water chute with two extensions each extending approximately in parallel with the interior walls of the outer shell, the chute having an annular upright hub with a number of outwardly extending ribs pushed against the interior walls of the tubular housing to maintain an annular conduit communicating with the outlet opening of the neck section for receiving at least a part of water through the main valve, and the chute extensions having at their respective tips a nozzle hole for directing a pressurized stream of water obliquely toward the center of the base skirt of the shell;

a dome-shaped outer rotor rotationally positioned in the base skirt under the water chute, the outer rotor having a top bearing sleeve and a number of fans extending along the exterior surfaces of the rotor body for receiving the pressurized impacts of the water streams to activate the outer rotor in a first direction, the outer rotor having a flat bottom which is provided with a cleaning brush at least temporarily;

an internal nozzle positioned inside of the outer rotor and extending in opposite directions approximately in parallel with the interior walls of the outer shell, the internal nozzle having an elongated annular axial stem with an external diameter for snugly threading through the bearing sleeve of the outer rotor but providing a fastening engagement with the interior of the upright hub of the water chute, the internal nozzle also having a control ball valve controlled by a knob through both of the axial stem and the housing of the shell and a smaller bearing sleeve that forms an inner annular conduit communicating with an outlet side of the control valve for receiving water which amounts to none to approximately half the water stream at the outlet opening of the neck section depending on the combined degree of opening of the main and control valves, the internal nozzle also forming an enclosed water chamber for ejecting two opposite water streams toward the center of the base skirt of the shell in the opposite direction to the direction of the water ejections of the water chute; and a dome-shaped inner rotor rotationally positioned within the span of the internal nozzle, the inner rotor having a shaft rotationally inserted through the bearing sleeve of the internal nozzle and a number of fans extending along the exterior surfaces of the rotor body for receiving the pressurized impacts of the water streams from the internal nozzle to activate the inner rotor in a second direction opposite to the first direction.

2. The cleaning attachment of claim 1, further comprising a handle attachment connected between the cleaning attachment and the water hose in a sealing engagement to allow a fluid communication and a convenient handling of the attachment against a cleaning surface.

3. The cleaning attachment of claim 1, wherein the connector is a separate member attached to a flared top end of the neck section of the outer shell for tightening it to the water hose in a sealing engagement.

4. The cleaning attachment of claim 1, wherein the bottoms of the rotors are replaceable and selected from a group of cleaning edges including brushes of different firmness and other abrasive surfaces.

5. The cleaning attachment of claim 1, wherein the water chute extends in diametrically opposite spiral directions while the internal nozzle extends in the similar spiral shape but in reverse to the water chute direction of extensions.

6. A cleaning attachment to water hose comprising:

an outer shell having a dome-shaped base skirt, a generally tubular housing protruding from the top center of the base skirt and terminating with a shoulder and a neck section protruding upwardly from the shoulder of the housing and having an inlet opening with a connector for tightening the neck section of the outer shell to the water hose in a sealing engagement and a couple of outlet openings connected to the housing;

a twin valve including two laterally positioned larger inner diameters at the side of the inlet opening of the neck section, two smaller inner diameters connected to the larger inner diameters;

an outer water chute with two extensions each extending approximately in parallel with the interior walls of the outer shell, the chute communicating with one of the outlet openings of the neck section for receiving at least a part of water through one of the valves, and the chute extensions having at their respective tips nozzle holes for directing pressurized streams of water obliquely toward the center of the base skirt of the shell;

a dome-shaped outer rotor rotationally positioned in the base skirt under the water chute, the outer rotor having a top bearing sleeve and a number of fans extending along the exterior surfaces of the rotor body for receiving the pressurized impacts of the water streams to activate the outer rotor in a first direction, the outer rotor having a flat bottom which is provided with a cleaning brush at least temporarily;

an inner water chute within the space of the outer rotor having two extensions attached to a dome-shaped inner shell extending approximately in parallel with the interior walls of the outer shell, the chute communicating with the other of the outlet openings of the neck section for receiving at least a part of water through the other valve, and the inner chute extensions having at their respective tips a nozzle hole for directing a pressurized stream of water obliquely toward the center of the base skirt of the shell in a direction opposite to the direction of the water stream from the outer water chute; and a dome-shaped inner rotor rotationally positioned within the span of the inner water chute, the inner rotor having a shaft rotationally inserted through a bearing sleeve in the inner water chute and a number of fans extending along the exterior surfaces of the rotor body for receiving the pressurized impacts of the water streams from the nozzle holes of the inner water chute to activate the inner rotor in a second direction opposite to the first direction of rotation of the outer rotor.

7. The cleaning attachment of claim 6, further comprising a handle attachment connected between the cleaning attachment and the water hose in a sealing engagement to allow a fluid communication and a convenient handling of the attachment against a cleaning surface.

8. The cleaning attachment of claim 6, wherein the connector is a separate member attached to a flared top end of the neck section of the outer shell for tightening it to the water hose in a sealing engagement.

9. The cleaning attachment of claim 6, wherein the bottoms of the rotors are replaceable and selected from a group of cleaning edges including brushes of different firmness and other abrasive surfaces.

10. The cleaning attachment of claim 6, wherein the outer water chute extends in diametrically opposite spiral directions while the inner water chute extends in the similar spiral shape but in reverse to the outer water chute direction of extensions.

11. A cleaning attachment to water hose comprising:

an outer shell having a base skirt, a housing protruding from the base skirt and terminating with a shoulder and a neck section protruding upwardly from the shoulder of the housing and having an inlet opening with a connector for tightening the neck section of the outer shell to the water hose in a sealing engagement and a couple of outlet openings connected to the housing;

an outer water chute with two extensions each extending approximately in parallel with the interior walls of the outer shell, the outer water chute communicating with one of the outlet openings of the neck section for receiving at least a part of water through one of the valves, and the outer water chute extensions having at their respective tips nozzle holes for directing pressurized streams of water obliquely toward the center of the base skirt of the shell;

an outer rotor rotationally positioned in the base skirt under the water chute, the outer rotor having a top bearing sleeve and a number of fans extending along the exterior surfaces of the rotor body for receiving the pressurized impacts of the water streams to activate the outer rotor in a first direction, the outer rotor having a flat bottom which is provided with a cleaning brush at least temporarily;

a twin valve including two laterally positioned larger inner diameters at the side of the inlet opening of the neck section, two smaller inner diameters connected to the larger inner diameters;

an inner water chute within the space of the outer rotor having two extensions attached to a inner shell extending approximately in parallel with the interior walls of the outer shell, the chute communicating with the other of the outlet openings of the neck section for receiving at least a part of water through the other valve, and the inner chute extensions having at their respective tips a nozzle hole for directing a pressurized stream of water obliquely toward the center of the base skirt of the shell in a direction opposite to the direction of the water stream from the outer water chute; and a inner rotor rotationally positioned within the span of the inner water chute, the inner rotor having a shaft rotationally inserted through a bearing sleeve in the inner water chute and a number of fans extending along the exterior surfaces of the rotor body for receiving the pressurized impacts of the water streams from the nozzle holes of the inner water chute to activate the inner rotor in a second direction opposite to the first direction of rotation of the outer rotor.

12. The cleaning attachment of claim 11, further comprising a handle attachment connected between the cleaning attachment and the water hose in a sealing engagement to allow a fluid communication and a convenient handling of the attachment against a cleaning surface.

13. The cleaning attachment of claim 11, wherein the connector is a separate member attached to a flared top end of the neck section of the outer shell for tightening it to the water hose in a sealing engagement.

14. The cleaning attachment of claim 11, wherein the bottoms of the rotors are replaceable and selected from a group of cleaning edges including brushes of different firmness and other abrasive surfaces.

15. The cleaning attachment of claim 11, wherein the outer water chute extends in diametrically opposite spiral directions while the inner water chute extends in the similar spiral shape but in reverse to the outer water chute direction of extensions.

16. The cleaning attachment of claim 15, wherein the bottoms of the rotors are replaceable and selected from a group of cleaning edges including brushes of different firmness and other abrasive surfaces.

* * * * *